US007047943B1

(12) United States Patent
Kanno

(10) Patent No.: US 7,047,943 B1
(45) Date of Patent: May 23, 2006

(54) ENGINE CONTROL SYSTEM FOR OUTBOARD MOTOR

(75) Inventor: Isao Kanno, Shizuoka (JP)

(73) Assignee: Yamaha Marine Kabushiki Kaisha (JP)

( * ) Notice: Subject to any disclaimer, the term of this patent is extended or adjusted under 35 U.S.C. 154(b) by 0 days.

(21) Appl. No.: 09/626,870

(22) Filed: Jul. 27, 2000

(30) Foreign Application Priority Data

Jul. 27, 1999 (JP) ..... 11-212827

(51) Int. Cl.
*F02N 51/00* (2006.01)

(52) U.S. Cl. ..... 123/479

(58) Field of Classification Search ..... 123/479, 123/480, 198 D, 333
See application file for complete search history.

(56) References Cited

U.S. PATENT DOCUMENTS 3,834,361 A * 9/1974 Keely ..... 123/32 EA
4,726,798 A 2/1988 Davis
4,843,914 A 7/1989 Koike
4,903,662 A 2/1990 Hirukawa et al.
4,966,115 A 10/1990 Ito et al.
5,062,401 A 11/1991 Suganuma
5,072,629 A 12/1991 Hirukawa et al.
5,117,792 A 6/1992 Kanno
5,136,279 A 8/1992 Kanno
5,403,246 A 4/1995 Umemoto
5,584,266 A 12/1996 Motose et al.
5,605,135 A * 2/1997 Netherwood ..... 123/479
5,645,032 A 7/1997 Motose
5,669,349 A 9/1997 Iwata et al.
5,827,150 A 10/1998 Mukumoto
5,970,951 A 10/1999 Ito

FOREIGN PATENT DOCUMENTS

JP 4-12139 1/1992

* cited by examiner

*Primary Examiner*—Mahmoud Gimie
(74) *Attorney, Agent, or Firm*—Knobbe, Martens, Olson & Bear, LLP

(57) ABSTRACT

A control system for an internal combustion engine includes a fuel injection control system having a first mode, wherein fuel injectors are controlled based on engine condition data supplied by a first group of sensors, and a second mode wherein fuel injectors are controlled based on engine condition data supplied by a second group of sensors. During normal operation of the engine, the control system switches between the first and second control modes based upon an engine operating condition (e.g., engine speed and/or engine load). If one of the sensors of the first group of sensors malfunctions, the control system controls the engine only in accordance with the second control mode. If one of the sensors of the second group of sensors malfunctions, the control system controls the engine only in accordance with the first control mode. In the case of a sensor malfunction in either of the first or second groups, the control system will reduce the engine speed as an alarm to apprise the operator of an engine malfunction.

24 Claims, 5 Drawing Sheets

ENGINE CONTROL SYSTEM FOR OUTBOARD MOTOR

PRIORITY INFORMATION

This application is based on and claims priority to Japanese Patent Application No. 11-212827, filed Jul. 27, 1999, which is hereby incorporated by reference in its entirety.

BACKGROUND OF THE INVENTION

1. Field of the Invention

This invention relates to a fuel injection control system for an engine, and more particularly to a fuel injection control system that is suitable for an outboard motor.

2. Description of Related Art

In order to improve engine performance, and in particular fuel efficiency and emissions, many types of engines use a fuel injection system for supplying fuel to the engine. A fuel injection system often includes fuel injectors that directly inject fuel into an air induction device. The amount of fuel injected through the fuel injectors is determined by a control system, which usually includes an electronic control unit (ECU). Typically, the ECU determines the desired amount of fuel and the corresponding fuel/air ratio based upon signal inputs from sensors that detect various engine conditions. The control system can therefore improve performance by precisely controlling the fuel/air ratio for each cycle of the engine and over a wide variety of engine running conditions. The control system can also optimize other engine systems such as, for example, ignition.

Because the ECU typically receives signal inputs from various sensors around the engine, if one of the sensors malfunctions, the ECU may use signal input from other sensors to determine the amount of fuel and the corresponding fuel/air ratio. In such cases, the engine will continue to run; however, the engine would be capable of better performance if data from the failed sensor was available. Operators of watercraft, however, often do not appreciate the reduced performance of the outboard motor or the increase in hydrocarbon and nitrogen oxides emissions. If the operator remains unaware of the sensor malfunction, this condition will remain until the next time the engine is serviced (assuming that sensor diagnostics are performed at the time of service).

SUMMARY OF THE INVENTION

A need therefore exists for an improved engine control system that uses sensor data to optimize engine performance and alerts the operator to malfunctions in certain key sensors.

In accordance with a first aspect of the present invention, an internal combustion engine comprises a throttle valve, an ignition system and a plurality of combustion chambers. A fuel delivery system is adapted to deliver a fuel charge to each of the combustion chambers, and a plurality of engine condition sensors are adapted to detect associated engine condition data. A control system receives the data from the engine condition sensors and controls operation of the fuel delivery system and the ignition system. The engine has a first operational state, which is defined by a first range of throttle valve openings, and a second operational state, which is defined by a second range of throttle valve openings. The control system includes a default control condition wherein the control system controls the fuel delivery system in accordance with a first control mode with the engine running in the first operational state and controls the fuel delivery system in accordance with a second control mode with the engine running in the second operational state. The control system further is adapted to reduce engine speed upon detecting a malfunction of one of the sensors.

In accordance with another aspect of the present invention, an internal combustion engine comprises a throttle valve, an ignition system, at least one combustion chamber, and a fuel injection system adapted to deliver a fuel charge to the combustion chamber. A plurality of engine condition sensors are adapted to detect associated engine condition data, and a control system receives the data from the engine condition sensors. The control system controls the operation of the fuel injection system in accordance with a first operational mode when a first range of an engine condition is detected by a first engine condition sensor and in accordance with a second operational mode when a second range of the engine condition is detected by the first engine condition sensor. The control system determines a fuel injection amount based upon a first set of parameters received from a first group of engine condition sensors when operating under the first operational mode and upon a second set of parameters received from a second group of engine condition sensors when operating under the second operational mode. The control system is further configured to signal malfunctioning of the engine in the event that one of the engine condition sensors of either the first or second group fails.

A preferred method of controlling engine operation involves providing a plurality of engine condition sensors adapted to detect engine operating conditions and to relay engine condition data to a control unit; analyzing the data in the control unit; controlling fuel delivery amounts to at least one combustion chamber of the engine in accordance with a first control mode based upon engine condition data detected by a first group of one or more sensors; controlling fuel delivery amounts to at least the one combustion chamber in accordance with a second control mode based upon engine condition data detected by a second group of one or more sensors; controlling fuel delivery amounts only in accordance with the first control mode upon detection of a malfunction of a sensor of the second group of one or more sensors; and actuating an alarm upon malfunction of one of the sensors.

For purposes of summarizing the invention and the advantages achieved over the prior art, certain objects and advantages of the invention have been described herein above.

BRIEF DESCRIPTION OF THE DRAWINGS

The above-mentioned and other features of the invention will now be described with reference to the drawings of the preferred embodiment of the present control system. The illustrated embodiment of the control system is intended to illustrated but not to limit the invention. The drawings contain the following figures.

DETAILED DESCRIPTION OF PREFERRED EMBODIMENTS OF THE INVENTION

Figure 1:
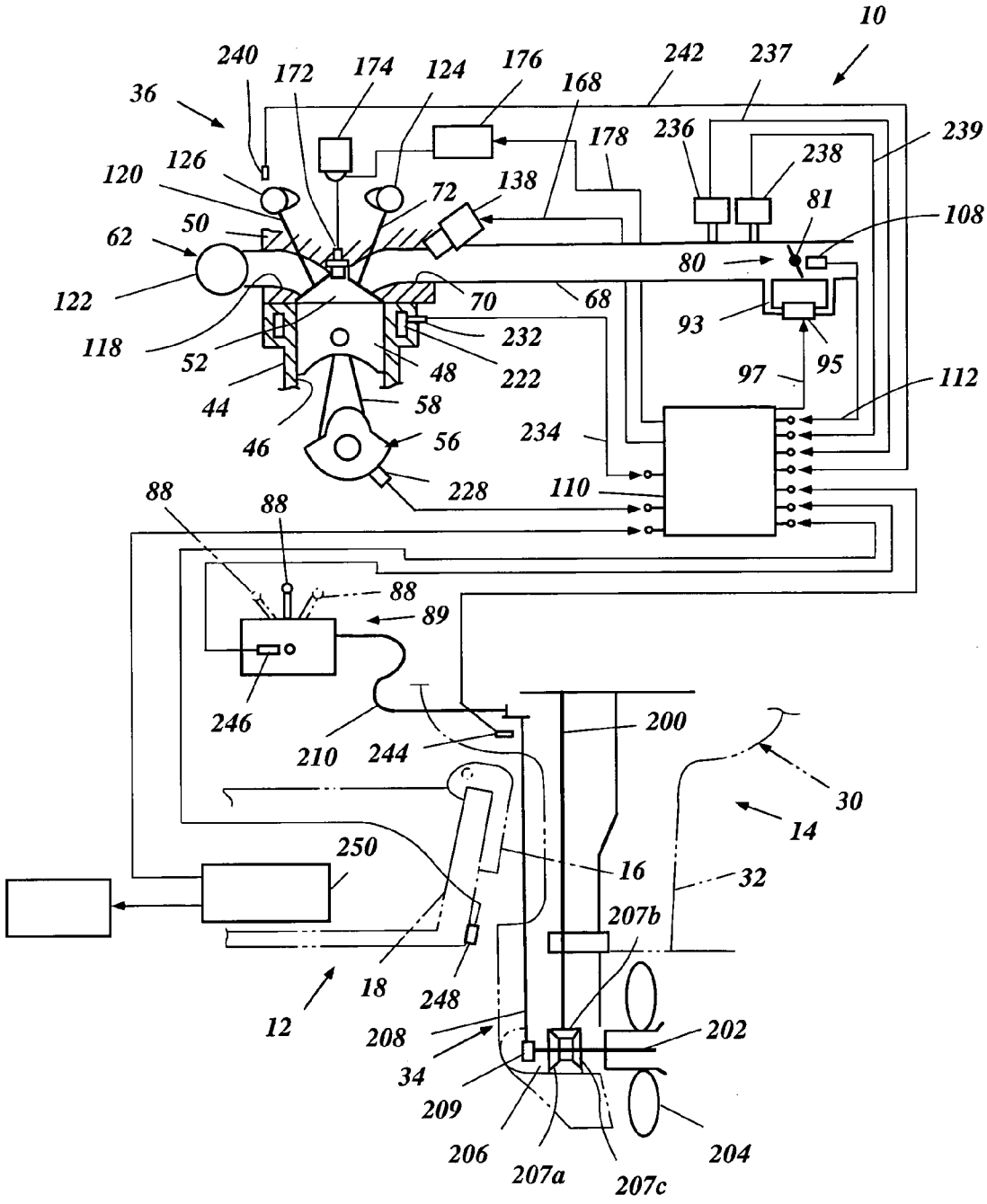
FIG. 1 is a schematic view showing an outboard motor in accordance with an embodiment of the present invention. An engine in part and an ECU are shown generally in the upper half of the figure. The outboard motor in part with a transmission, a shift device and an associated watercraft are shown in the lower half of the figure.
Figure 2:
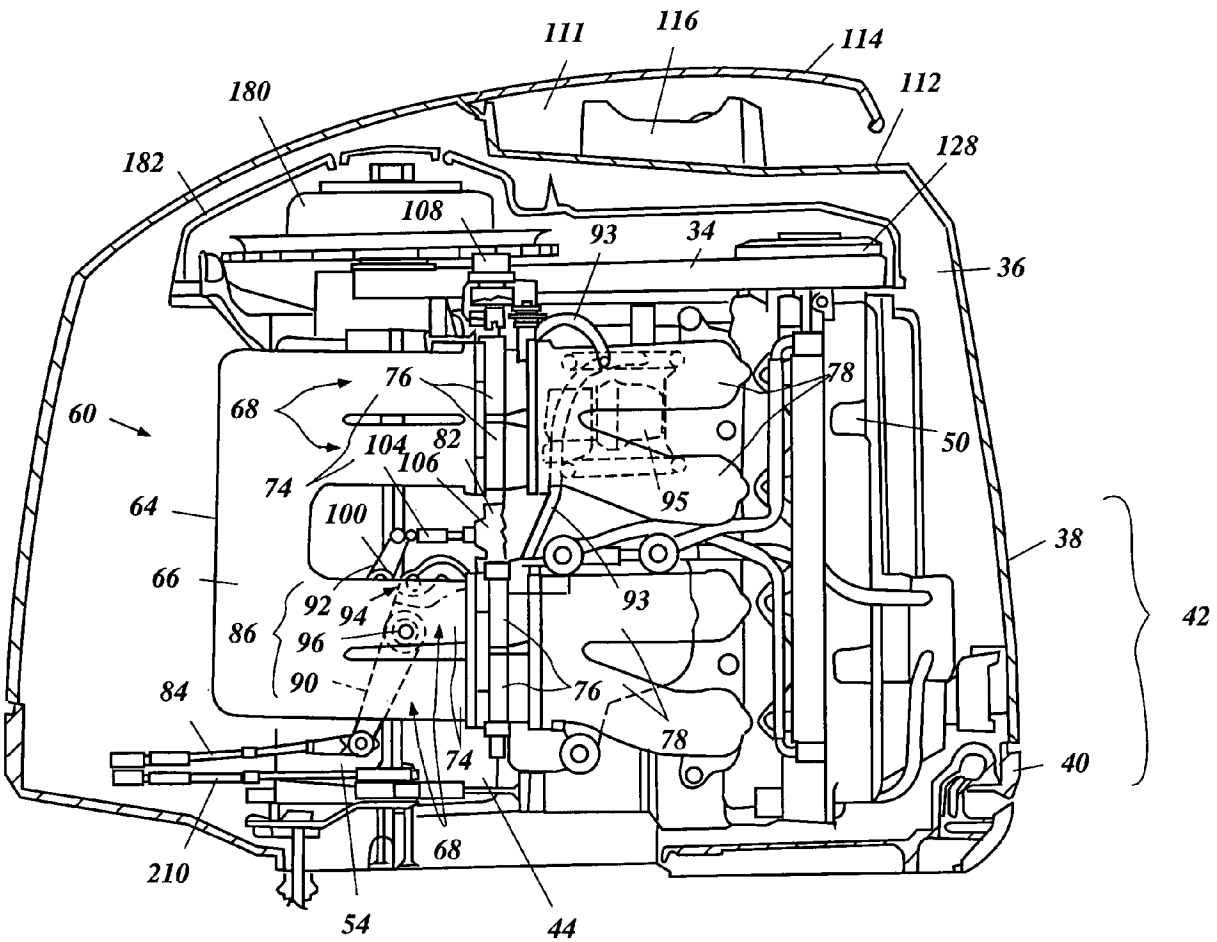
FIG. 2 is an elevational side view of the powerhead of the outboard motor shown in FIG. 1. An upper and a lower protective cowling members are shown in section.
Figure 3:
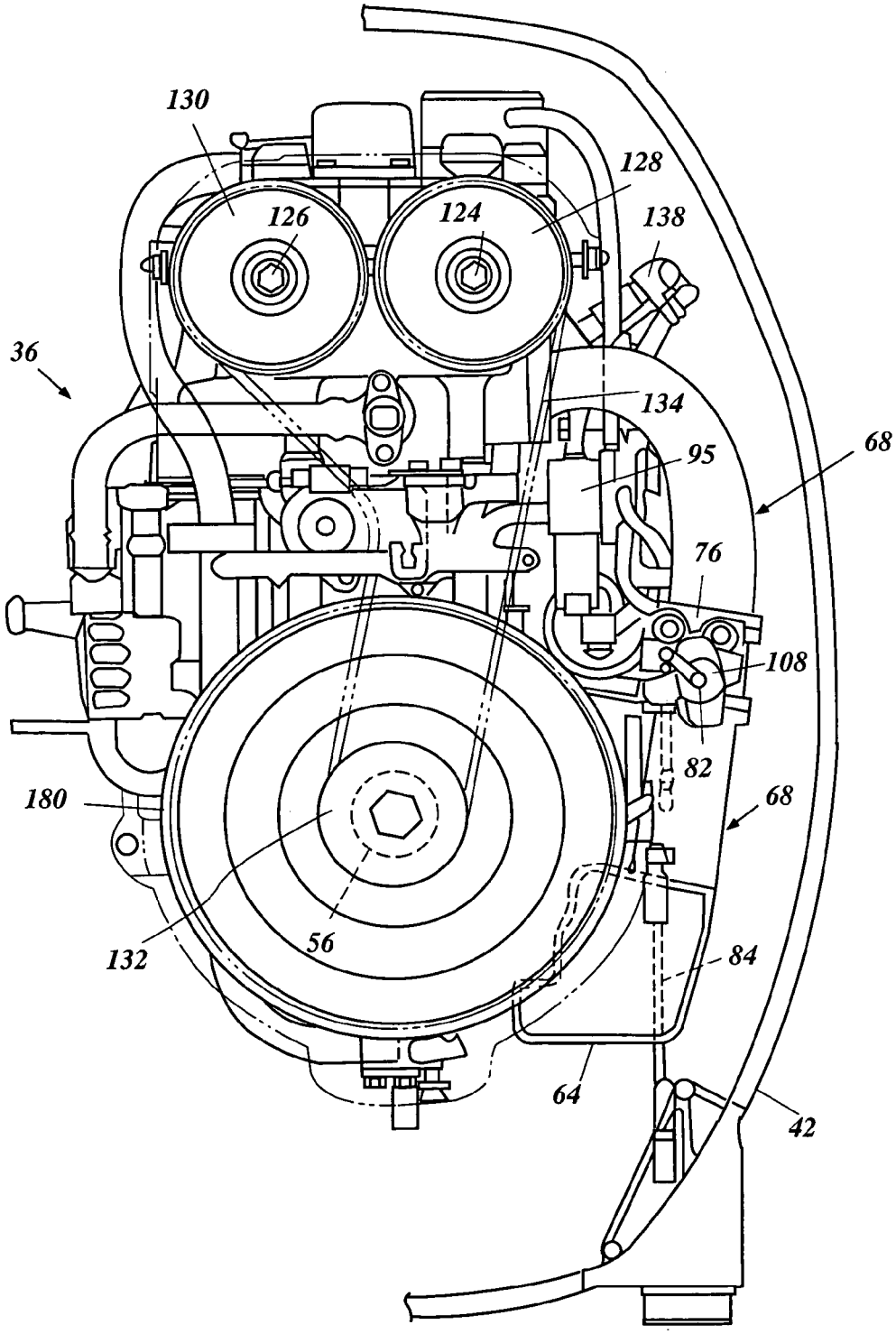
FIG. 3 is a top plan view of the engine shown in FIG. 2. The upper protective cowling is detached and one half of the lower cowling is omitted.

With initial reference to FIGS. 1 to 3, an outboard motor 10 for powering a watercraft 12 is illustrated. The outboard motor 10 advantageously has a control system arranged and configured in accordance with certain features, aspects, and advantages of the present invention. The control system of the present invention may also find utility in other applications that require optimization of engine performance and alarms for indicating sensor malfunctions. Such applications might include, without limitation, personal watercraft, small jet boats, and off-road vehicles.

With reference first to FIG. 1, the outboard motor 10 in the illustrated embodiment comprises a drive unit 14 and a bracket assembly 16, shown schematically. The bracket assembly 16 comprises a swivel bracket and a clamping bracket. The swivel bracket supports the drive unit 14 for pivotal movement about a generally vertically extending steering axis. The clamping bracket, in turn, is affixed to a transom 18 of the watercraft 12 and supports the swivel bracket for pivotal movement about a generally horizontally extending axis. A hydraulic tilt system can be provided between the swivel bracket and clamping bracket to tilt up or down the drive unit 14. If this tilt system is not provided, the operator may tilt the drive unit 14 manually. Since the construction of the bracket assembly 16 is well known in the art, a further description is not believed to be necessary to enable those skilled in the art to practice the invention.

As used throughout this description, the terms "forward," "front" and "fore" mean at or to the side of the motor nearest the bracket assembly 16, and the terms "rear," "reverse" and "rearwardly" mean at or to the opposite side of the front side, unless indicated otherwise.

With reference to FIGS. 1–2, the drive unit 14 includes a drive shaft housing 32, and a lower unit 34. A power head 30 is disposed on a top end of the drive unit 14 and includes an engine 36, a top protective cowling 38 and a bottom protecting cowling 40. The cowlings 38, 40 define a cowling assembly 42.

The engine 36 operates on a four stroke combustion principle and powers a propulsion device. In the illustrated embodiment, a cylinder block 44 of the engine defines four cylinder bores 46, in which a corresponding number of pistons 48 reciprocate. The cylinder bores 46 extend generally horizontally and are spaced generally vertically from each other. As such, the engine 36 is an L4 (in-line 4 cylinder) type. It should be understood, however, that the engine 36 may be of any type (e.g., "V"-type or opposed), may have any number of cylinders and/or may operate under other principles of operation (e.g., two-cycle, rotary, or diesel principles).

A cylinder head assembly 50 is affixed to one end of the cylinder block 44. Four combustion chambers 52 are defined between the cylinder block 44 and respective pistons 48 and cylinder bores 46. The end of the cylinder block 44 opposite the cylinder head is closed with a crankcase member 54 (FIG. 2), which defines a crankcase chamber.

With reference to FIGS. 1 and 3, a crankshaft 56 extends generally vertically through the crankcase chamber. The crankshaft 56 is connected to the pistons 48 by connecting rods 58, and rotates with the reciprocal movement of the pistons 48 within the cylinder bores 46.

With reference again to FIGS. 1 and 2, the engine 36 includes an air induction system 60 and an exhaust system 62. The air induction system 60 is configured to supply air charges to the combustion chambers 52. The induction system 60 includes an air intake silencer 64 (FIG. 2), which defines an air intake manifold 66 therein. Four main intake passages 68 extend from the intake manifold 66 to a corresponding number of intake ports 70 formed on the cylinder head assembly 50.

The intake ports 70 are opened and closed by intake valves 72. When the intake ports 70 are opened, air from the intake passages 68 and intake ports 70 flows into the combustion chambers 52.

The intake silencer 64 is positioned on the port side of the crankcase member 54 and has an inlet opening (not shown) at its front side that opens to the interior of the cowling assembly 42. The air intake passages 68 extend rearwardly from the intake manifold 66 along the cylinder block 44 and curve toward the intake ports 70. The respective intake passages 68 are vertically spaced apart from each other.

With reference to FIG. 2, the air intake passages 68 are defined by duct sections 74, throttle bodies 76, and runners 78. The duct sections 74 are formed integrally with the intake silencer 64.

With reference again to FIG. 1, the respective throttle bodies 76 each support a throttle valve 80 therein for pivotal movement about a generally-vertically-disposed valve shaft axis 81. As shown in FIGS. 2–3, the valve shafts are linked together to form a single valve shaft assembly 82 that passes through the throttle bodies 76.

The throttle valves 80 are operable via a throttle cable 84 (FIG. 2) and a non-linear control mechanism 86. The throttle cable 84 is connected to a throttle/shift lever 88 (FIG. 1) that is positioned within an operational control unit 89. The operational control unit 89 is positioned in the watercraft 12 so as to be operable by an operator of the watercraft 12.

With reference to FIG. 2, the non-linear control mechanism 86 includes a first lever 90 and a second lever 92 joined together with each other by a cam connection 94. The first lever 90 is pivotally connected to the throttle cable 84 and also to a first pin 96, which is affixed to the crankcase member 54. The second lever 92 is generally "L"-shaped and is pivotally connected to a second pin 100, which is affixed to the crankcase member 54. The second lever 92 connects to a control rod 104. The control rod 104, in turn, is pivotally connected to a lever member which is connected to the throttle valve shaft assembly 82 via a torsion spring 106 that urges the control rod 104 to the position shown in FIG. 2. At this position of the control rod 104, the throttle valve 80 is in a closed position wherein almost no air charge can pass through the air intake passages 68.

When the throttle cable 86 is operated by the throttle/shift lever 88, the first lever 90 pivots about the first pin 96 in a counter-clockwise direction, as viewed in FIG. 2. The second lever 92, then pivots about the second pin 100 in a clockwise direction, thus pushing the control rod 104 against the bias force of the torsion spring 106 to open the throttle valves 80. When the throttle cable 84 is released, the control rod 104 is urged back to its initial position by the biasing force of the spring 106, and the throttle valves 80 are closed.

With reference also to FIG. 1, a throttle valve position sensor 108 is positioned on a top end of the throttle valve shaft assembly 82. The position sensor 108 sends a signal via a throttle position data line 112 to an Electronic Control Unit (ECU) 110, which is mounted on the left side of the engine 36. The signal from the throttle valve position sensor 108 corresponds to throttle opening and the engine load. The position sensor 108 and the ECU 110 are preferably part of an engine control system which controls various aspects of engine operation and will be described in more detail below.

The illustrated air induction system 60 includes a bypass passage or idle air supply passage 93 that bypasses the throttle valves 80. An idle air adjusting unit 95, which includes a butterfly valve or another kind of valve therein, is provided in the bypass passage 93. The idle air adjusting unit 95 is positioned between the cylinder block 44 and the air intake passages 68. The valve in the idle air adjusting unit 95 is controlled by the ECU 110 through a signal line 97.

With particular reference to FIG. 2, the cowling assembly 42 generally completely encloses the engine 36. The upper cowling 38 is detachably affixed to the bottom cowling 40 so that an operator can access the engine 36 for maintenance or other purposes. The upper cowling 38 has an air intake compartment 111 defined between a top surface 112 of the upper cowling 38 and a cover member 114. The air intake compartment 111 has an air inlet duct 116 that connects the space in the compartment 111 and the interior of the cowling assembly 42.

In operation, air is introduced into the air intake compartment 111 and enters the interior of the cowling assembly 42 through the air inlet duct 116. The air then passes through the inlet opening of the intake silencer 64 and enters the intake manifold 66. The air then flows through the ducts 74, to the body 76 where an air charge amount is controlled by the throttle valves 80 to meet the requirements of the engine 36. The air charge then proceeds through the runner 78, intake port 70, and intake valve 72 into the combustion chamber 52.

Under the idle running condition, the throttle valves 80 are generally closed. The air, therefore, enters the ports 70 through the idle air adjusting unit 95, which is controlled by the ECU 110. The adjusting unit 95 regulates the volume of air supplied to the combustion chambers 52 during engine idle.

With reference again to FIG. 1, a fuel injector 138 is positioned adjacent each injection intake port 70. Each fuel injector has an injection nozzle adapted to direct fuel toward the combustion chambers 52. The fuel charge is delivered by the fuel injector into the corresponding combustion chamber 52 in conjunction with an air charge at the moment the intake valve 72 is opened. The fuel injector 138 is preferably opened and closed by a solenoid. Each solenoid is controlled by the ECU 110, which is connected to the injector by a fuel injector control line. A fuel injector control system, which will be described in more detail below, directs the operation of the fuel injector. While the fuel delivery system of the illustrated embodiment involves an indirect fuel injection system, other charge forming systems, including, but without limitation, a direct fuel injection system, can also be used.

With continued reference to FIG. 1, the engine further includes an ignition system having a spark plug 172 and coil 174 associated with each combustion chamber 52, and an actuator 176 for controlling the coils 174 and spark plugs 172. The ECU 110 signals the actuator 176, which in turn activates a particular coil 174 which fires the associated spark plug 172 according to a desired timing pattern. The signal from the ECU 110 to the actuator 176 is carried along an ignition control line 178.

An exhaust system 62 is configured to discharge burnt charges or exhaust gasses from the combustion chambers 52 to the environment. Exhaust ports 118 are defined in the cylinder head assembly 50 adjacent each combustion chamber 52 and are opened and closed by exhaust valves 120. When the exhaust ports 118 are opened, the combustion chambers 52 communicate with exhaust passages 122 that lead the exhaust gasses downstream through the exhaust system 62.

An intake camshaft 124 and an exhaust camshaft 126 are provided to control the opening and closing of the intake valve 72 and exhaust valves 120, respectively. The camshafts 124, 126 extend approximately vertically and are substantially parallel to each other. The camshafts 124, 126 have cam lobes that act upon the respective valves 72, 120 at predetermined timings to open and close the respective ports. The camshafts 124, 126 are journaled on the cylinder head assembly 50 and are driven by the crankshaft 56 via a camshaft drive unit. In the illustrated embodiment, the camshaft drive unit is positioned at the upper end of the engine 36, as viewed in FIG. 3.

The camshaft drive unit includes sprockets 128, 130 mounted to an upper end of the camshafts 124, 126, respectively. The crankshaft 56 also includes a sprocket 132 at an upper end thereof. A timing belt or chain 134 is wound around the sprockets 128, 130, 132. Thus, the cam shafts 124, 126 are driven by the crankshaft 156.

Figure 4:
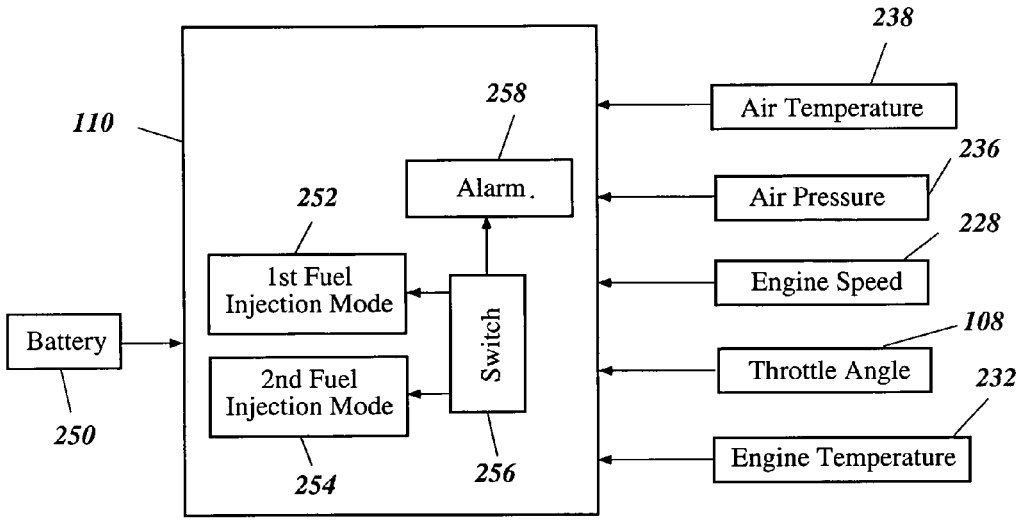
FIG. 4 is a diagram showing the relationship of various sensor inputs and electronic control system.

As shown in FIGS. 2 and 3, a flywheel assembly 180 is positioned at an upper end of the crankshaft 56. A cover member 182 covers the flywheel assembly 180, sprockets 128, 130, 132, and the belt 134 so as to prevent debris and/or other foreign materials from becoming entrained in the sprockets 128, 130, 132 and to protect an operator from the moving components when the upper cowling 38 is removed. The flywheel assembly 180 includes a generator that generates electric power, which is accumulated in a battery 250 (FIG. 4).

As seen in the lower half of FIG. 1, the driveshaft housing 32 depends from the power head 30 and supports a driveshaft 200 that is driven by the crankshaft 56 of the engine 36. The driveshaft 200 extends generally vertically through the driveshaft housing 32. The driveshaft housing 32 also defines internal passages (not shown) which form portions of the exhaust system 62.

The lower unit 34 depends from the driveshaft housing 32 and supports a propeller shaft 202 which is driven by the driveshaft 200. The propeller shaft 202 extends generally horizontally through the lower unit 34. A propeller 204 is affixed to an outer end of the propeller shaft 202.

A transmission 206 is provided between the driveshaft 200 and the propeller shaft 202. The transmission 206 has bevel gears 207*a*, 207*b*, 207*c* that couple the two shafts 200, 202 together so that rotation of the drive shaft 200 is translated to the propeller shaft 202.

A switchover mechanism is provided for the transmission 206 to shift rotational directions of the propeller 204 between forward, neutral and reverse. The switchover mechanism includes a shift cam 209, a shift rod 208 and shift cable 210. The shift rod 208 extends generally vertically through the driveshaft housing 32 and the lower unit 34, while the shift cable 210 extends outwardly from the lower cowling 40 (see FIG. 2) and is connected to the throttle/shift lever 88, which is operable by the operator when the operator desires to change the transmission directions.

The lower unit 34 also defines an internal passage that forms a discharge section of the exhaust system 62. At engine speeds above idle, the majority of the exhaust gasses are discharged to the body of water surrounding the outboard motor 10 through the internal passage and finally through a hub of the propeller 204.

The outboard motor 10 also includes a cooling system for cooling heated portions in the engine 36 such as the cylinder block 24 and cylinder head assembly 50. In the illustrated embodiment, a water jacket 222 (FIG. 1) is provided in the cylinder block 44. A water pump (not shown) is provided for supplying cooling water to the various water jackets which may be included in the engine 36, including the water jacket 222. The water pump can be driven by the driveshaft 200. Although not shown, a water inlet is provided in the lower unit 34 to draw cooling water from the body of water surrounding the motor 36. The water is supplied to the water jackets through a water supply conduit.

As noted above, the engine control system controls various engine operations including firing of the spark plugs 174 and actuation of the fuel injectors. The engine control system includes the ECU 110 and various sensors and actuators. To appropriately control the engine 36, the engine control system utilizes maps, indices and/or instruction sets stored within the memory of the ECU 110 to analyze the data collected from various sensors and control the engine in response to such data. For example, the engine control system may refer to data collected from the throttle valve position sensor 108 and other sensors provided for sensing engine running conditions, ambient conditions or conditions of the outboard motor 10 that will affect engine performance.

Some of the more important sensors for the engine control system now will be described. It should be appreciated that it is practicable to provide other sensors, such as, for example, an engine height sensor, a trim angle sensor, a knock sensor, a neutral sensor, a watercraft pitch sensor, a shift position sensor and an atmospheric temperature sensor in accordance with various control strategies.

As seen in FIG. 1, there is provided, associated with the crankshaft 56, a crankshaft angle position sensor 228. The crankshaft position sensor 228 preferably defines a pulse generator that produces pulses as the crankshaft 56 rotates. The pulses are, in turn, converted to an engine speed within the ECU 110 or another separate converter (not shown) by measuring crankshaft angle versus time.

A water temperature sensor 232 is connected to the cylinder block 44 so as to communicate with the water jacket 222. The water temperature sensor 232 is configured to sense the temperature of water flowing through the water jacket 222 and to output a water temperature signal to the ECU 110 via a water temperature data line 234.

An intake air pressure sensor 236 is connected to one of the air intake passages 68. The air intake pressure sensor 236 is configured to sense the pressure of the air in the intake passage 68 and to output an air pressure signal to the ECU 110 via an air pressure signal line 237.

An intake air temperature sensor 238 is connected to one of the air intake passages 68 and is configured to sense the temperature of the air in the intake passage. The intake air temperature sensor 238 outputs an air temperature signal to the ECU 110 via an air temperature signal line 239.

Associated with either the intake or the exhaust camshaft 124, 126 is a cylinder identifying sensor 240. In the illustrated embodiment, the cylinder identifying sensor 240 is configured to sense the rotation of the exhaust camshaft 126. The cylinder identifying sensor preferably defines a pulse generator that produces pulses as the exhaust camshaft 126 rotates. The signal of the sensor 240 is transmitted to the ECU 110 via a signal line 242. The position of the pistons 48 with respect to the combustion cycle can be determined by comparing the pulse generated by the cylinder identifying sensor 240 to the pulse generated by the crankshaft angle position sensor 228.

The outboard motor 10 also preferably includes: a shift position sensor 244 that indicates the position of the shift rod 208, a lever speed sensor 246 that senses the rotational velocity of the shift lever 88, and a watercraft velocity sensor 248 that is located at the lowermost portion of the transom 18 and senses the velocity of the watercraft 12.

With next reference to FIG. 4, the engine control system comprises the ECU 110, which is powered by the battery 250 and is adapted to receive electronic data signals from various sensors, perform steps to analyze the data, and send control commands to various engine systems in order to optimize engine performance. For example, as shown in FIG. 4, the ECU 110 receives electronic data from the intake air temperature sensor 238, intake air pressure sensor 236, engine speed sensor 228, throttle angle sensor 108, and engine temperature sensor 232, analyzes the data and sends control commands to fuel injectors 138 and the ignition actuator 136.

It has been found that data from certain sensors is more valuable in determining the optimum fuel injection parameters at certain engine speeds and/or throttle angles. Accordingly, the ECU 110 preferably has a fuel injection subsystem for controlling the fuel injection. The fuel injection sub-system preferably operates under a first fuel injection mode 252 and under a second fuel injection mode 254. In the first fuel injection mode 252, the ECU 110 evaluates the intake pressure, engine speed and throttle angle when determining the optimum fuel injection parameters. In the second fuel injection mode 254, the ECU 110 evaluates engine speed and throttle angle to determine optimum fuel injection parameters. The first fuel injection mode 252 is used when a relatively small throttle angle has been detected, and the second fuel injection mode 254 is used when a relatively large throttle angle has been detected.

In each of the first and second modes, a set of instructions is provided for the ECU 110 to evaluate the data received from the relevant sensors. Having multiple modes of operation allows the instruction sets to be specially tailored for certain engine conditions and speeds. For example, the set of instructions in the first fuel injection mode 252, which considers the intake negative pressure and engine speed at relatively small throttle angles, does not result in a particularly desirable air-fuel ratio at a high engine speed and high throttle angle. Thus, it is desirable to use the instruction set of the second fuel injection mode 254 at such relatively high throttle angles. A switch 256 of the ECU 110 receives a data signal from the throttle angle sensor 108 and switches between the first and second fuel injection modes 252, 254 at appropriate times. It is to be understood, however, that even if the first injection mode was to be used at a relatively high throttle angle, the engine would still run, and perhaps run well enough that the engine operator may not be able to tell that the engine is not performing at an optimum level.

Figure 5:
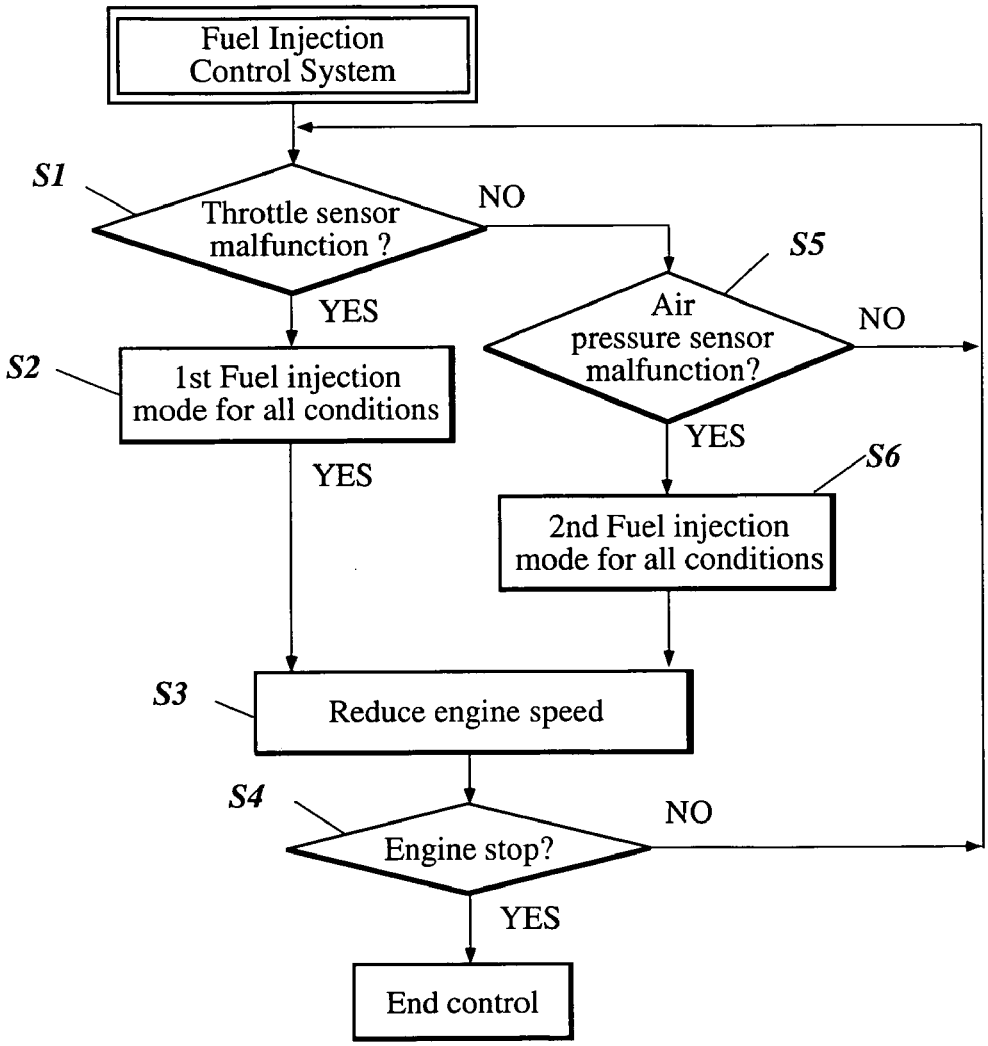
FIG. 5 is flow diagram of an engine control routine that can be used in the ECU of FIG. 1.

Occasionally, engine sensors may malfunction and fail to provide data required by the ECU. The fuel injection control system includes contingency instructions for dealing with such cases. With reference also to FIG. 5, a routine for responding to a failed or malfunctioning sensor is provided, as well as an embodiment of the first and second modes. With reference to decision block S1, if the ECU detects that the throttle angle sensor 108 is malfunctioning, the switch 256 will switch control of the fuel injection system over to the first injection mode 252 for all operation states of the engine, even those states at which the second fuel injection mode is typically employed (see step S2). If the throttle angle sensor 108 is functioning properly, the ECU 110 will then evaluate, as shown in decision block S5, whether the intake air pressure sensor 236 is malfunctioning. If the intake air pressure sensor 236 is functioning properly, the loop starts over again at decision block S1; however, if the intake air pressure sensor 236 is malfunctioning, the fuel injection system will employ the second fuel injection mode 254 for all operational states of the engine, including those states usually controlled by the first fuel injection mode 252 (see step S6).

The determination of a faulty reading from a signal can be determined in any of a variety of ways. For example, the sensor can output a reading which is outside a normal range of operation (such range being stored in the ECU's memory). Upon detecting that the sensor's reading is outside such range, the ECU determines that the sensor has malfunctioned. In some applications, such a faulty reading needs to be received for a given period of time before the ECU reaches this conclusion. A constant reading from a sensor for more than a given amount of time can also be indicative of a malfunction (even through such reading could be in the normal range) and can be used by the ECU to reach this determination.

As discussed above, although the engine will not run at optimum performance levels when there is a sensor malfunction, the engine will still run, and it is possible that the operator will be unaware that there is any problem with the engine. As long as the operator is unaware of the problem, it is unlikely that the sensor malfunction will be addressed until an occasion arises for a technician to inspect the sensors. As a result, engine performance will be compromised and may even result in increased engine wear. Accordingly, with reference to FIGS. 4 and 5, an alarm 258 is provided to alert the operator of the engine problem. As used herein, "alarm" means a manifestation that alerts the operator that the engine is not functioning properly. As noted below, this can be done in a variety of ways including, but without limitation, varying engine operation and/or using audio or visual signals to alert the watercraft operator.

When a malfunction of the throttle angle sensor 108 or the intake air pressure sensor 236 has been detected, and the fuel injection system has switched to exclusive use of either the first or second fuel injection mode, the ECU 110 will execute commands to limit the engine speed to below a pre-determined value as shown in step S3. This limit on engine speed serves as an alarm to alert the operator of the engine malfunction; however, the engine will continue to run so that the operator can transport the watercraft to a safe location suitable for repair. Once the engine speed has been reduced in accordance with step S3, the reduced engine speed continues until the engine is stopped (step S4) and control is terminated.

The ECU 110 can use any suitable means for limiting the engine speed. For example, the ECU can disable one or more of the cylinders using various means, such as stopping or reducing the supply of fuel to the combustion chamber 52 by controlling the fuel injector 138, delaying ignition timing, or skipping ignition altogether.

In alternative embodiments, the fuel injection system may have varied levels of sophistication. For example, the fuel injection system may have only a single injection mode or a number of injection modes, each adapted to be employed during certain engine conditions. Such injection modes may balance data input from one or all of the engine condition sensors in various ways and according to various instruction sets. It is to be understood, however, that upon malfunction of an important sensor, an alarm can be actuated to apprise the operator of the malfunction, while maintaining the engine in running fashion. This alarm preferably includes reducing the engine speed so that the operator will be motivated to have the sensor malfunction resolved promptly. Alternatively, the alarm can comprise a flashing or continuous light, or the alarm can comprise various sound effects (i.e., an audible alarm).

The foregoing description is that of certain features, aspects and advantages of the present invention to which various changes and modifications may be made without departing from the spirit and scope of the present invention. Moreover, a watercraft may not feature all objects and advantages discussed above to use certain features, aspects and advantages of the present invention. Thus, for example, those skilled in the art will recognize that the invention may be embodied or carried out in a manner that achieves or optimizes one advantage or group of advantages as taught herein without necessarily achieving other objects or advantages as may be taught or suggested herein. Moreover, many of the steps of the routines described above can be performed in various orders, as will be well understood by one skilled in the art from the above description, while still carrying out one or more objects or advantages of the present invention. The present invention, therefore, should only be defined by the appended claims.

What is claimed is:

1. An internal combustion engine comprising a throttle valve, an ignition system, a plurality of combustion chambers, a fuel delivery system adapted to deliver a fuel charge to each of the combustion chambers, a plurality of engine condition sensors adapted to detect associated engine condition data, and a control system, the control system adapted to receive the data from the engine condition sensors and further adapted to control operation of the fuel delivery system and the ignition system, the engine having a first operational state defined by a first range of throttle valve openings and a second operational state defined by a second range of throttle valve openings, and the control system having a default control condition wherein the control system controls the fuel delivery system in accordance with a first control mode with the engine running in the first operational state or controls the fuel delivery system in accordance with a second control mode with the engine running in the second operational state, the control system further being adapted to reduce engine speed upon a detection error of one of the sensors.

2. The engine of claim 1, wherein the fuel delivery system comprises a plurality of fuel injectors, and each fuel injector communicates with one of the combustion chambers.

3. The engine of claim 1, wherein the first control mode determines fuel delivery system control parameters in accordance with engine condition data detected by a first group of one or more sensors and the second control mode determines fuel delivery system control parameters in accordance with engine condition data detected by a second group of one or more sensors.

4. The engine of claim 3, wherein the first control mode determines fuel delivery system control parameters in accordance with engine condition data detected by an intake air pressure sensor and the second control mode determines fuel delivery system control parameters in accordance with engine condition data detected by a throttle angle sensor.

5. The engine of claim 4, wherein the control system is adapted to control the fuel delivery system in accordance with the first control mode in both the first and second operational states upon a malfunction of the throttle angle sensor.

6. The engine of claim 4, wherein the control system is adapted to control the fuel delivery system in accordance with the second control mode in both the first and second operational states upon a malfunction of the intake air pressure sensor.

7. The engine of claim 3, wherein the control system is adapted to control the fuel delivery system in accordance with the first control mode in both the first and second operational states upon a malfunction of one of the second group of one or more sensors.

8. The engine of claim 1, wherein the control system is adapted to reduce engine speed by delaying ignition timing.

9. The engine of claim 1, wherein the control system is adapted to reduce engine speed by disabling at least one combustion chamber.

10. The engine of claim 9, wherein the cylinder is disabled by the control system withholding fuel flow to the combustion chamber.

11. The engine of claim 1, wherein the control system is adapted to reduce engine speed by partially disabling the ignition system.

12. The engine of claim 1, wherein the control system is adapted to reduce engine speed by reducing the volume of fuel delivered to the combustion chambers of the engine.

13. The engine of claim 1 in combination with an outboard motor, the outboard motor comprising a cowling and a propulsion device, the engine being positioned within the cowling and being arranged to drive the propulsion device.

14. A method for controlling engine operation comprising the steps of providing a plurality of engine condition sensors adapted to detect engine operating conditions and relay engine condition data to a control unit, analyzing the data in the control unit, controlling fuel delivery amounts to at least one combustion chamber of the engine in accordance with a first control mode based upon engine condition data detected by a first group of one or more sensors, controlling fuel delivery amounts to at least the one combustion chamber in accordance with a second control mode based upon engine condition data detected by a second group of one or more sensors, controlling fuel delivery amounts only in accordance with the first control mode upon detection of a malfunction of a sensor of the second group of one or more sensors, controlling fuel delivery amounts only in accordance with the second control mode upon detecting a malfunction of a sensor of the first group of one or more sensors and actuating an alarm upon malfunction of one of the sensors.

15. The method of claim 14, wherein actuating the alarm comprises reducing engine speed.

16. The method of claim 15, wherein the engine speed is reduced by disabling at least one combustion chamber of the engine.

17. The method of claim 14 additionally comprising sensing an engine condition over first and second ranges, and switching between the first and second control modes depending upon whether the engine condition is in the first or second range.

18. An internal combustion engine comprising a throttle valve, an ignition system, at least one combustion chamber, a fuel injection system adapted to deliver a fuel charge to the combustion chamber, a plurality of engine condition sensors adapted to detect associated engine condition data, and a control system, the control system adapted to receive the data from the engine condition sensors and further adapted to control operation of the fuel injection system, the control system controlling operation of the fuel injection system in accordance with a first operational mode when a first range of an engine condition is detected by a first engine condition sensor or in accordance with a second operational mode when a second range of the engine condition is detected by the first engine condition sensor, the control system determining a fuel injection amount based upon a first set of parameters received from a first group of engine condition sensors when operating under the first operational mode and upon a second set of parameters received from a second group of engine condition sensors when operating under the second operational mode, and further being configured to signal malfunctioning of the engine in the event that one of the engine condition sensors of either the first or second group fails.

19. The engine of claim 18, wherein the control system is adapted to limit engine speed to signal engine malfunction.

20. The engine of claim 19, wherein the control system reduces engine speed by at least partially disabling at least one of the cylinders.

21. The engine of claim 18, wherein the control system activates a light to signal engine malfunction.

22. The outboard motor of claim 18, wherein the first engine condition sensor comprises a throttle valve angle sensor.

23. The outboard motor of claim 22, wherein the first range of engine conditions comprises small throttle angles, and the second range of engine conditions comprises large throttle angles.

24. The outboard motor of claim 18, wherein the engine condition sensors of the first and second groups are chosen from a group consisting of an intake air pressure sensor, engine speed sensor, and throttle valve angle sensor.

* * * * *